US006217382B1

(12) United States Patent
Ziers

(10) Patent No.: US 6,217,382 B1
(45) Date of Patent: Apr. 17, 2001

(54) COAXIAL CABLE ESD BLEED

(75) Inventor: David G. Ziers, Monte Bello, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/488,237

(22) Filed: Jan. 20, 2000

(51) Int. Cl.[7] ..... H01R 9/05
(52) U.S. Cl. ..... 439/578; 439/181; 439/675
(58) Field of Search ..... 439/578, 181, 439/88, 675

(56) References Cited

U.S. PATENT DOCUMENTS 4,664,467 * 5/1987 Tengler et al. ..... 439/581
4,718,864 * 1/1988 Flanagan ..... 439/578
5,529,522 * 6/1996 Huang ..... 439/578
5,802,710 * 9/1998 Bufanda et al. ..... 439/578

* cited by examiner

*Primary Examiner*—Brian Sircus
*Assistant Examiner*—Hae Moon Hyeon
(74) *Attorney, Agent, or Firm*—T. Gudmestad

(57) ABSTRACT

An ESD bleed path for a coaxial cable (10). A disk (20) is provided around a center pin (18) of a SMA connector (12) for a center conductor (22) of the coaxial cable (10) in order to provide a bleed path for a floating center conductor (22). The disk (20), preferably made of carbon loaded with kapton, fits over the center pin (18) of a male portion (14) of the SMA connector (12). The disk (20) is compressed between the male portion (14) of the SMA connector (12) and the female portion (16) of the SMA connector (12). The compression connection provides electrical contact among the connector (12), the disk (20), the center conductor (22) and the outer conductors (23, 25) of the connector (12) and the cable (10). The present invention provides an electrostatic discharge bleed path for the center conductor (22) of the coaxial cable (10).

7 Claims, 2 Drawing Sheets

COAXIAL CABLE ESD BLEED

TECHNICAL FIELD

The present invention relates to a ?,(SMA) connector for a coaxial cable and more particularly to providing an electrostatic discharge (ESD) bleed path for a floating center conductor of the coaxial cable.

BACKGROUND ART

Coaxial cables and radio frequency switches that are used to leave a communications port open circuited are located inside the payload of a communications satellite and are usually well shielded. The center conductor of a coaxial cable connected to an RF switch may be electrically floating when it is not being used as a path for a RF signal.

The energy of electrons in a space environment is capable of causing the floating center conductor to charge to a high potential. When the cable is switched into a RF path, it is possible to induce a transient pulse from the floating center conductor onto a circuit in the RF path. The problem is that the induced pulse may cause damage to the electronics and in particular to sensitive monolithic microwave integrated circuits (MMIC) in the RF path.

To avoid this potentially serious problem, it is possible to insert coaxial attenuators having a low attenuation value into the paths that are susceptible to the transient pulse. However, this technique takes up valuable space due to the need for more cable roughing space, thereby adding unwanted weight to the spacecraft. In addition, the technique adds insertion loss, which is also undesirable.

It is also possible to continuously monitor space weather in order to determine optimum conditions for switching RF switches. RF switches are temperature dependent and simply waiting for the center conductor current potential to drop to a satisfactory level may be enough to prevent transients from entering the RF circuit. However, the monitoring method is extremely costly in that continuous, real-time space weather monitoring is required. Furthermore, scheduling problems arise because, say at 20° C., it could take up to four days for the center conductor potential to drop to a satisfactory level. The scheduling problems adversely affect customer revenues due to the fact that the switches may be out of commission for an extended period of time.

According to flight data the probability of damage to sensitive electronic circuits during the switching process is low. However, should it occur, the effects could be extremely costly. Therefore, what is needed is a low cost method for preventing potential damage to sensitive electronic components without adversely affecting weight, and without occupying very limited, and very valuable, space onboard a spacecraft.

SUMMARY OF THE INVENTION

The present invention provides an electrostatic discharge bleed path for the center conductor of a coaxial cable. The present invention prevents spacecraft hardware damage by preventing the center conductor from charging in an enhanced electron environment, such as in a space environment, when no other bleed paths are available. Additionally, the present invention has minimal impact on the RF performance characteristics of the SMA connection.

In order to accomplish the above advantages, the present invention is realized in a disk fitted over the center pin, or contact, of a SMA male connector to bleed electrostatic charge. Preferably the disk is made of a polamide material, such as Kapton® which is a registered trademark of DuPont Corporation loaded with carbon. The disk is compressed between the male and female portions of the SMA connector, thereby providing an electrical connection among the connector, the inner conductor and the outer conductor of the coaxial cable.

The center conductor of a coaxial cable connected to an RF switch may be electrically floating when it is not being used as a path for a RF signal. In operation, the floating center conductor has a bleed path to ground through the electrical connection of the disk and coaxial cable outer conductor. Therefore, when switching occurs, the center conductor potential is well within satisfactory limits and the risk of damage to MMIC components is eliminated.

It is an object of the present invention to provide an electrostatic discharge bleed path when no other bleed paths are available. It is another object of the present invention to avoid potential damage to sensitive hardware by preventing charge build-up on a center conductor of a coaxial cable. It is yet another object of the present invention to prevent an unwanted transient pulse from being introduced into a circuit in a RF path when a coaxial cable is switched into the RF path.

Other objects and features of the present invention will become apparent when viewed in light of the detailed description of the preferred embodiment when taken in conjunction with the attached drawings and appended claims.

BRIEF DESCRIPTION OF THE DRAWINGS

In order that the invention may be well understood, there will now be described an embodiment thereof, given by way of example with reference being made to the accompanying drawings, in which.

BEST MODE(S) FOR CARRYING OUT THE INVENTION

Figure 1:
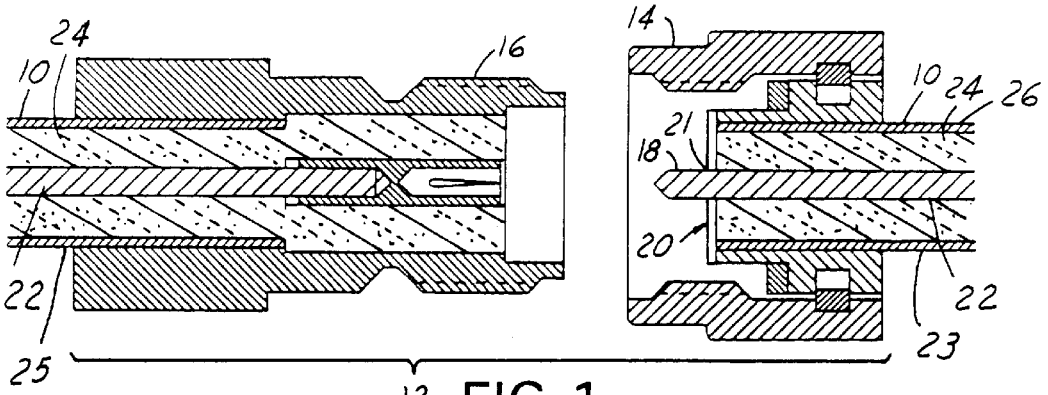
FIG. 1 is a cross-sectional view of a segment of coaxial cable having a SMA plug that includes the coaxial cable ESD bleed of the present invention.
Figure 1A:
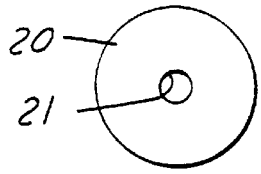

FIG. 1 shows cross-sectional view of a segment of coaxial cable 10 having a SMA connector 12 attached thereto. The SMA connector 12 has a plug 14 and a jack 16. The plug 14 has a center pin 18. The present invention is a disk 20 that fits over the center pin 18 of the SMA plug 14. The disk 20 is typically made of a polyamide material, such as DuPont's Kapton®, loaded with carbon and provides low-level (i.e., 0.1 dB) attenuation in order to ground a center conductor 22 of the coaxial cable 10. The disk 20 has an opening 21 therethrough that is slightly smaller than the dimensions of the center pin 18 to provide electrical contact with the center pin 18. For example, the diameter of the opening 21 in the disk 20 may be 0.034–0.035 inches, while the center pin 18 may have a diameter of 0.036 inches.

The plug 14 mates with a jack 16 such that the periphery of the disk 20 is clamped between the outer conductors 23, 25 of the SMA plug 14 and jack 16 respectively. The clamping action provides electrical contact between the disk 20 and the outer conductor 25 of the coaxial cable. The electrical contact between the disk 20, the center pin 18, and the outer conductors 23, 25 combined with the intrinsic resistivity of the disk 20 provide and ESD bleed path for the center conductor 22 to the outer conductor 25. Due to the high resistivity and small thickness of the disk 20, there is minimal impact on the RF performance of the connection.

When a coaxial cable 10 is not being used in the path of a RF signal, its center conductor 22 is electrically floating. The energetic electrons in a space environment cause the floating center conductor 22 to charge to a high potential.

The disk 20 of the present invention provides an electrostatic discharge bleed path for the center conductor 22 of the coaxial cable 10. The bleed path prevents the build up of excess charge in an enhance electron environment, thereby preventing a transient pulse from occurring when the coaxial cable 10 is switched into a RF path. Without the concern of an induced pulse, there is no concern that sensitive electronic components in the RF path may be damaged when the switch occurs.

Operation of the present invention will be described in conjunction with the present example along with FIGS. 1 through 5. It should be noted that the values, test procedures and methods used in the present example are for example purposes only. It is possible to use other techniques and methods and one skilled in the art is capable of substituting alternative techniques and method to accomplish similar results.

A coaxial cable 10 is similar to a leaky capacitor. Any charge stored on the center conductor 22 can leak to ground by conduction through the core 24, which is typically a Teflon material. The potential of the center conductor 22 is a function of both electron flux and the resistivity of the Teflon insulation.

The coaxial cable 10 has a well-defined geometry and it is possible to present the cable mathematically as two concentric cylinders. The resistance (r) and capacitance (c) per unit length of a coaxial cable 10 are well known and can be found in many sources including *Foundations of Electromagnetic Theory,* J. Reitz and F. Milford, Addison Wesley, 1967. The potential (V) of the center conductor 22 as a function of time(t) is given by the equation:

$$V=jr(1-e^{-1/(rc)}) \quad (1)$$

where, $$c=(2\pi k\epsilon_o)/[\ln(r_o/r_i)] \quad (2)$$

and $$r=[\eta\ln(r_o/r_i)/2\pi \quad (3)$$

In equations (1), (2), and (3), $r_i$ is the radius of the center conductor 22 and $r_o$ is the radius of the copper jacket 26. $\eta$ is the resistivity of the Teflon insulation material 24, $\epsilon_o$ is the absolute permittivity, k is the relative dielectric constant of the Teflon insulation 24 of the coaxial cable 10. For Teflon, k=2. Equation (1) can be rewritten as:

$$V=jr(1-e^{-(t/k\epsilon o\eta)}) \quad (4)$$

Figure 2:
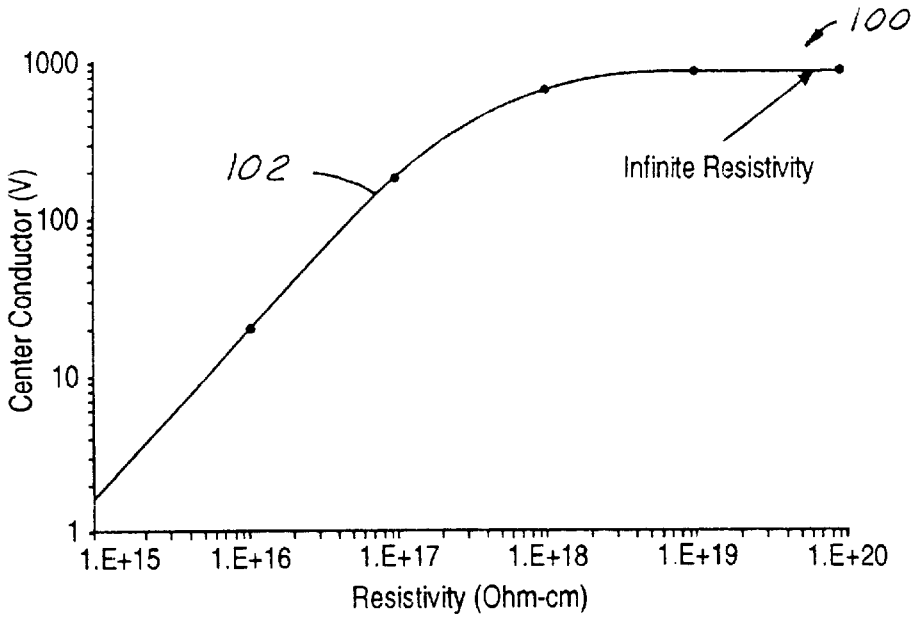
FIG. 2 is a graph of a plot representing the center conductor potential as a function of resistivity after a coaxial cable has been exposed to an enhanced energetic electron environment.

FIG. 2 is a graph 100 of a plot 102 showing the potential (V) of the center conductor as a function of the resistivity of the Teflon insulation 24 after the coaxial cable 10 has been exposed to an enhanced electron environment of 25xAE8 for approximately twenty-four hours. The center conductor potential (V) can be as high as 840 Volts if the Teflon insulation 24 has a high resistivity, i.e. no leakage. However, if the resistivity should approach somewhere in the range of $10^{16}$ Ohms, then the center conductor potential (V) could be less than 100 Volts. Consequently, the resistivity of the Teflon plays a key role in determining the potential of a floating center conductor 22.

In general, the resistivity of a material is temperature dependent. Orders of magnitude of resistivity could occur over a temperature range of 100° C. For purposes of the present example, assume the expected operation temperature of RF switches to be between −5° C. and 60° C.

Figure 3:
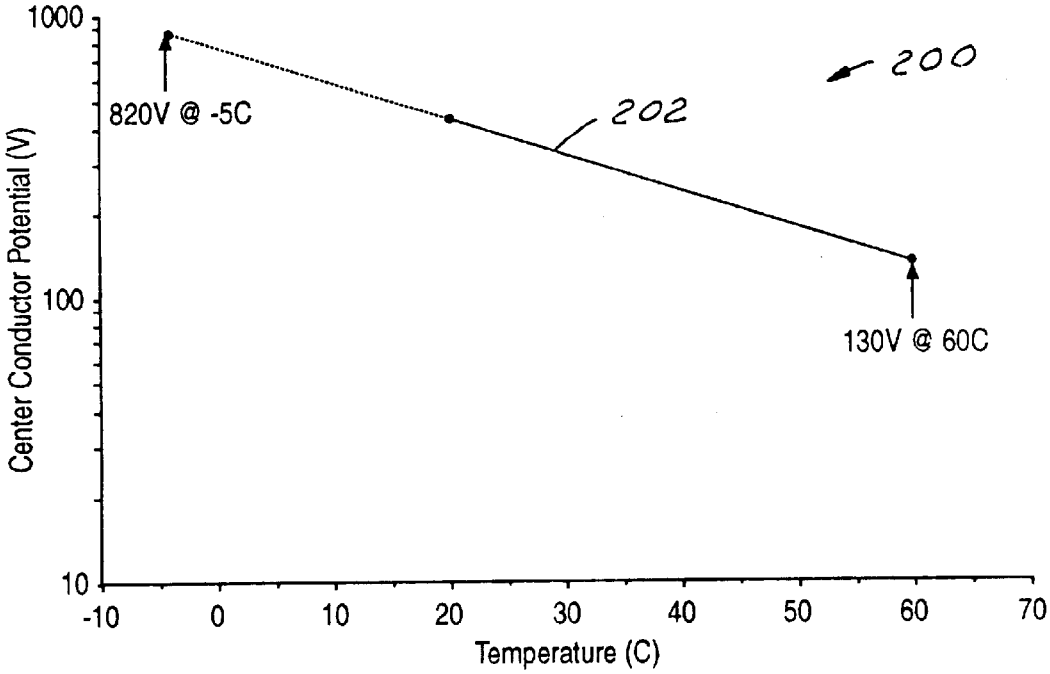
FIG. 3 is a graph of a plot representing center conductor potential as a function of temperature at the coaxial cable.

The resistivity of Teflon covers a wide range of values, i.e. $10^{16}$ Ohm-cm to $10^{22}$ Ohm-cm. Therefore, a test was performed to calculate the resistivity of the Teflon on a coaxial cable/R type switch combination. Resistivity measurements were taken at temperatures of 20° C. and at 60° C. The resistance between the center conductor 22 and ground were used to measure resistance value and derive a value for the resistivity of Teflon. The leakage resistance was determined by measuring the time constant decay of the center conductor potential. The resistivity of Teflon over the entire operation temperature range was determined by extrapolation of the test data. FIG. 3 is a graph 200 having a plot 202 that represents the center conductor potential (V) as a function of temperature in ° C.

In operation, an RF switch is used to leave a port open circuited and to switch the coaxial cable 10 into a RF path. At this point in time, it is possible for the center conductor 22 of the coaxial cable 10 to dump any charge it has stored onto a sensitive electronic circuit in the RF path, inducing a transient pulse on that circuit.

Figure 4:
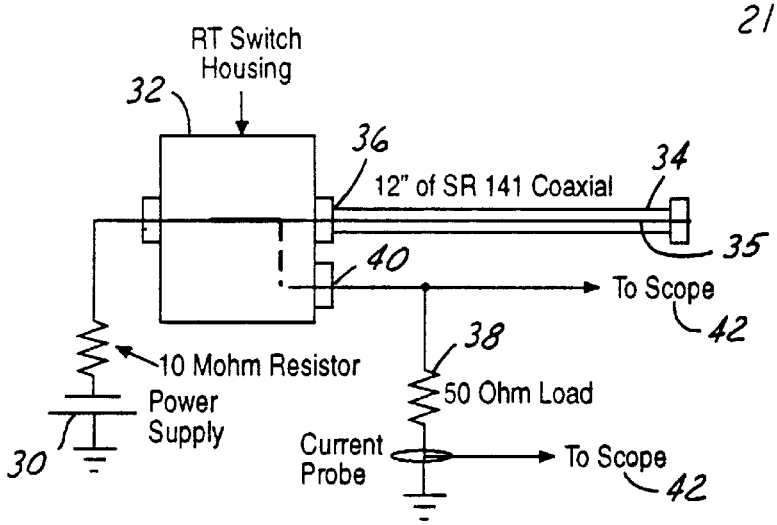
FIG. 4 is a schematic diagram of a test setup used to determine the size of an induced transient pulse.
Figure 5:
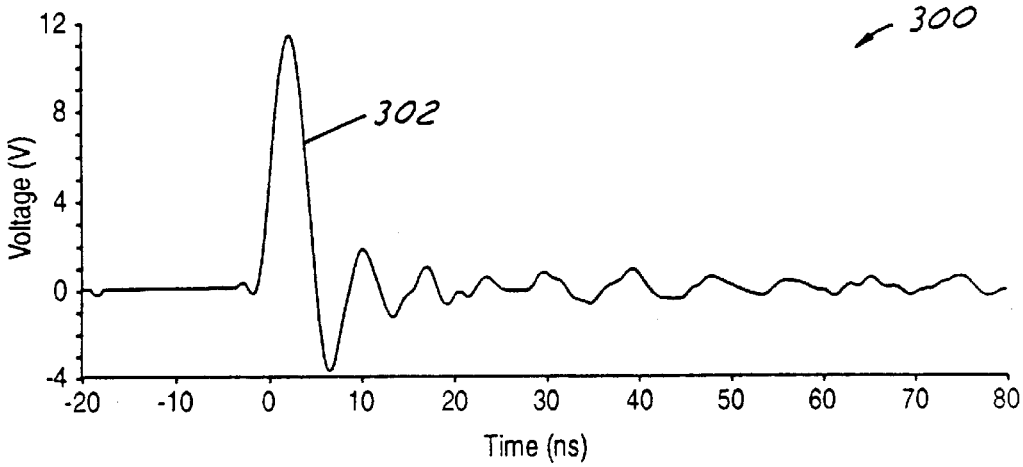
FIG. 5 is a graph of a plot representing a pulse induced by switching a floating center conductor into a RF path.

A test was performed to determine the amplitude of the induced pulse. A diagram of the test setup is shown in FIG. 4. A power supply 30 feeds an RF switch 32. The switch 32 has a coaxial cable 34 attached at an input port 36. A 50-Ohm load 38 is connected to an output port 40. The test included charging the center conductor 35 of the coaxial cable 34 using the power supply 30, and then switching the cable 34 onto the 50 Ohm load 38, then measuring the pulse induced across the 50 Ohm load using a scope 42. FIG. 5 is a graph 300 showing a typical waveform 302. The rise time of the pulse is approximately 2 ns. Table 1 summarizes the results as follows:

TABLE 1

| Applied Voltage (V) | Peak Induced Voltage (V) | Pulse Width (ns) |
|---|---|---|
| 10 | 4.7 | 2 |
| 10 | 3.9 | 2 |
| 20 | 11.8 | 2 |
| 20 | 11.4 | 2 |
| 20 | 11.2 | 2 |

The amplitude of the induced pulse was 40%–60% of the voltage bias applied to the center conductor.

It was estimated that the highest floating center conductor potential is 820 Volts. Should the RF switch be activated with the center conductor at this potential, a 500 Volt pulse could be injected into a sensitive electronic circuit. A pulse of this amplitude would damage the electronic components. In fact, typical sensitive electronic circuit components should not be subjected to a transient pulse greater than 50 Volts. This implies that, in the present example, the center conductor potential should be kept below 80 Volts.

In order to consistently maintain the center conductor potential below 80 Volts, the coaxial cable must have a direct current, (DC) ground. This is accomplished by incorporating the disk 20 of the present invention to the SMA connector 12 in the manner described above. The disk 20 adds a low-level attenuator in series with the coaxial cable 10. A typical attenuator has relatively low impedance, i.e. <1 MΩ, between the center conductor and ground, and is adequate to bleed-off charge stored on a floating center conductor. The disk 20 of the present invention provides a DC path to ground for the center conductor of each coaxial cable in a spacecraft system.

While a particular embodiment of the invention has been shown and described, numerous variations and alternate embodiments will occur to those skilled in the art. Accordingly, it is intended that the invention be limited only in terms of the appended claims.

What is claimed is:

1. A method for providing an electrostatic charge bleed path for an electrically floating center conductor in a coaxial cable having an outer conductor and a sub-miniature coaxial connector (SMA); said method comprising the steps of:

proving a direct current (DC) path between said electrically floating center conductor and said outer conductor wherein said DC path is provided by a conductive disk surrounding a center contact in a plug of said SMA connector and contacting said outer conductor.

2. The method as claimed in claim 1 wherein said step of providing a DC path by way of a disk further comprises said disk being made of carbon loaded kapton.

3. The method as claimed in claim 2 wherein said step of providing a DC path by way of a disk further comprises said disk having an opening therethrough that is smaller than an outer diameter of said center contact.

4. A device for providing an electrostatic discharge (ESD) coaxial cable having a center conductor, and outer conductor and a connector, said device comprising;

a conductive disk having an opening therethrough for electrically contacting a center pin of said connector and said outer conductor, thereby providing said ESD bleed path for said center conductor of said coaxial cable.

5. The device as claimed in claim 4 wherein said disk is made of carbon loaded kapton.

6. The device as claimed in claim 4 wherein said opening has a diameter that is smaller than an outer diameter of said center pin.

7. The device as claimed in claim 4 wherein a jack of said connector mates with said connector thereby compressing a periphery of said disk and wherein said compression connection provides electrical contact between said disk, said plug and said jack.

* * * * *